US008362421B2

(12) United States Patent
Fernandez De La Mora

(10) Patent No.: US 8,362,421 B2
(45) Date of Patent: Jan. 29, 2013

(54) USE ION GUIDES WITH ELECTRODES OF SMALL DIMENSIONS TO CONCENTRATE SMALL CHARGED SPECIES IN A GAS AT RELATIVELY HIGH PRESSURE

(75) Inventor: Juan Fernandez De La Mora, New Haven, CT (US)

(73) Assignee: Sociedad Europea de Analisis Diferencial de Movilidad, Madrid (ES)

( * ) Notice: Subject to any disclaimer, the term of this patent is extended or adjusted under 35 U.S.C. 154(b) by 0 days.

(21) Appl. No.: 12/672,168

(22) PCT Filed: Apr. 2, 2008

(86) PCT No.: PCT/EP2008/053960

§ 371 (c)(1),
(2), (4) Date: Feb. 4, 2010

(87) PCT Pub. No.: WO2009/121408

PCT Pub. Date: Oct. 8, 2009

(65) Prior Publication Data

US 2011/0049356 A1 Mar. 3, 2011

(51) Int. Cl.
*H01J 49/42* (2006.01)

(52) U.S. Cl. ..... 250/288

(58) Field of Classification Search ..... 250/292, 250/290, 396 R, 288, 281, 282
See application file for complete search history.

(56) References Cited

U.S. PATENT DOCUMENTS

| | | | | |
|---|---|---|---|---|
| 4,220,545 | A * | 9/1980 | Franzen et al. | 422/186.04 |
| 4,985,626 | A * | 1/1991 | Margulies | 250/292 |
| 6,107,628 | A | 8/2000 | Smith et al. | |
| 6,674,071 | B2 * | 1/2004 | Franzen et al. | 250/292 |
| 6,759,651 | B1 * | 7/2004 | Li | 250/288 |
| 7,259,371 | B2 * | 8/2007 | Collings et al. | 250/288 |
| 2003/0150987 | A1 | 8/2003 | Guevremont et al. | |
| 2009/0272891 | A1 * | 11/2009 | Giles | 250/282 |

FOREIGN PATENT DOCUMENTS

| | | | |
|---|---|---|---|
| EP | 1 391 912 | A2 | 2/2004 |
| GB | 2 421 845 | A | 7/2006 |
| WO | 2007079588 | A1 | 7/2007 |

* cited by examiner

*Primary Examiner* — Kiet T Nguyen
(74) *Attorney, Agent, or Firm* — Hoffmann & Baron, LLP

(57) ABSTRACT

The present invention is based on the observation that radio frequency (RF) electric fields in multi-pole lenses with small rod diameters in the range of 1 mm enables strongly concentrating ions suspended in a gas at pressures much higher than previously used for ion manipulation, including atmospheric pressure. Other lens configurations are described, including one based on the funnels of U.S. Pat. No. 6,107,628, and another on the coiled wire system of Hutchins et al. (1999). The finding provides a method to increase the concentration of ions transmitted to mass spectrometers and other analyzers, both from volatile or involatile species in solution, hence increasing their analytical sensitivity. It also enables improved charging efficiencies of neutral volatile species existing in the gas phase.

12 Claims, 3 Drawing Sheets

USE ION GUIDES WITH ELECTRODES OF SMALL DIMENSIONS TO CONCENTRATE SMALL CHARGED SPECIES IN A GAS AT RELATIVELY HIGH PRESSURE

REFERENCES CITED

Douglas D. J. and French J. B. (1990) Mass spectrometer and method and improved ion transmission, U.S. Pat. No. 4,963,736, Oct. 16, 1990

Douglas D. J. and French J. B. (1992) Collisional Focusing Effects in Radio-Frequency Quadrupoles, J. Am. Soc. Mass. Spectrometry, 3 (4): 398-408

Fenn J B, Mann M, Meng C K, Wong S F, Whitehouse C M, Electrospray ionization for mass-spectrometry of large biomolecules, Science 246 (4926): 64-71, 1989

Fernández de la Mora, J. and D. E. Rosner, Inertial Deposition of Particles Revisited and Extended: Eulerian Approach to a Traditionally Lagrangian Problem, Physico-Chemical Hydrodynamics 2, 1-21 (1981).

Fernández de la Mora, J., Drastic improvements on the resolution of aerosol size spectrometers via aerodynamic focusing: the case of variable-pressure impactors; Chemical Engineering Communications, 151, 101-124 (1996).

Fernández dc la Mora J. (2000) Electrospray ionization of large multiply charged species proceeds via Dole's charged residue mechanism, Analytica Chimica Acta, 406, 93-104

Franzen, J. and Brekenfeld, A. (2004), Ion-guide systems, U.S. Pat. No. 6,674,071, Jan. 6, 2004

Fuerstenau, S, P. Kiselev and J. B. Fenn, ESIMS in the Analysis of Trace Species in Gases, Proceedings of the 47th ASMS Conference on Mass Spectrometry (1999) Dallas Tex.;

Fuerstenau, S., Aggregation and Fragmentation in an Electrospray Ion Source, Ph.D. Thesis, Department of Mechanical Engineering, Yale University, 1994.

Hutchins D. K., Holm J., Addison S. R., Electrodynamic focusing of charged aerosol-particles, Aerosol Sci. & Tech. 14 (4): 389-405, 1991

Liu P., Ziemann P. J., Kittelson D. B., et al. (1995) Generating particle beams of controlled dimensions and divergence. 1. theory of particle motion in aerodynamic lenses and nozzle expansions, Aerosol Sci. Tech. 22: 293-313

Liu P., Ziemann P. J., Kittelson D. B., et al. (1995), Generating particle beams of controlled dimensions and divergence. 2. Experimental evaluation of particle motion in aerodynamic lenses and nozzle expansions, Aerosol Sci. Tech. 22: 314-324

McDaniel, E. W. and Mason, E. A. (1973) The mobility and diffusion of ions in gases, Wiley New York Robinson A. (1956) On the motion of small particles in a potential field of flow, Comm. Pure & Applied Math. 9, 69-84

Smith R. D. and Shaffer; Scott A. (2000), Method and apparatus for directing ions and other charged particles generated at near atmospheric pressures into a region under vacuum, U.S. Pat. No. 6,107,628, Aug. 22, 2000

Tolmachev, A. V., I. V. Chernushevich, A. F. Dodonov, K. G. Standing, A collisional focusing ion guide for coupling an atmospheric pressure ion source to a mass spectrometer, Nuclear Instruments and Meth. Phys. Res. B 124 (1997) 112-119

Tolmachev, A. V., H. R. Udseth and R. D. Smith, Radial stratification of ions as a function of mass to charge ratio in collisional cooling radio frequency multipoles used as ion guides or ion traps, *Rapid Commun. Mass Spectrom.* 14, 1907-1913 (2000)

Tolmachev, A. V., H. R. Udseth, R. D. Smith, Modeling the ion density distribution in collisional cooling RF multipole ion guides, International Journal of Mass Spectrometry 222 (2003) 155-174

Ude, S.; J. Fernandez de la Mora, B. A. Thomson, (2004) Charge-induced unfolding of multiply charged polyethylene glycol ions, J. Am. Chem. Soc., 126, 12184-12190

Whitehouse, C. M., F. Levin, C. K. Meng, and J. B. Fenn, Proc. 34th ASMS Conf. on Mass Spectrom. and Allied Topics, Denver, 1986, p. 507.

Wu, C.; W. F. Siems, and H. H. Hill, Jr., Secondary Electrospray Ionization Ion Mobility Spectrometry/Mass Spectrometry of Illicit Drugs, Anal. Chem. 2000, 72, 396-403.

FIELD OF THE INVENTION

This invention is concerned with the problem of concentrating ions existing at relatively high pressure in order to increase the sensitivity of analytical instruments such as mass spectrometers or other devices capable of analyzing such ions.

BACKGROUND OF THE INVENTION

General Background

There are many situations when small particles and ions suspended in a gas need to be analyzed and detected. For instance, to monitor pollution in the environment. Also in analytical applications, where ions formed at atmospheric pressure are introduced into mass spectrometers or other analyzers for the purpose of determining their concentrations and other characteristics, such as their mass, charge, electrical mobility, etc. These small particles or ions may preexist in the ambient, but they are often produced at atmospheric pressure by special procedures such as chemical ionization, electrospray (ES) ionization etc. The analytical instruments where they are sampled generally take a limited gas flow rate, whereby their sensitivity is limited by the concentration of the suspended particles or ions in the gas. It is therefore desirable to increase this concentration prior to sampling into such instruments. There are other instances where one wishes to concentrate ions or charged particles for purposes other than analyzing them. For instance, when these ions are used to charge neutral vapors existing in the atmosphere by virtue of their finite vapor pressure, whereby, once charged, such vapors are more easily detected. Charging neutral species is desirable, for instance, for the purpose of sniffing explosives or other substances of interest in environmental, food, or other applications. In this case it is convenient to distinguish between the charging ions or particles, and the ionized vapors. Charging of volatiles can be done in either bipolar or unipolar ionic atmospheres. In the first case, large concentrations of coexisting positive and negative ions can be generated, for instances with ionizing radiation or radioactive materials, though recombination of ions of opposite sign tends to discharge both the charging ions and the ionized vapors, thus limiting the charging probability of neutral species. In the case of volatile charging in unipolar atmospheres, space charge limits the concentration of the charging species, leading also to relatively small charging probabilities of the vapors, at most of the order of $10^{-4}$; but typically less. It is evident that the charging probability of these volatiles is proportional to the concentration of charging ions. It is therefore desirable to increase the concentration of charging species and keep it high over volumes much larger than currently allowed by space charge dispersion. One should note here that charging of volatiles may be achieved not only by charge transfer from other charged ions (for instance by proton transfer from protonated water clusters), but also by charge transfer from a spray of charged drops. The later method has been pioneered by John Fenn and his colleagues (Whitehouse et al. 1986; Fuerstenau, et al. 1999; Fuerstenau, 1994; Wu et al. 2000) with charged sprays of volatile liquids produced via so-called electrospray (ES; Fenn et al, 1989). Hence, the term ions in charging ions is used in the wide sense to mean ions, evaporating charged drops, or the mixture of both produced by electrosprays or other charged sprays.

Several schemes have been developed to achieve pre-concentration of species, as described for instances by Liu et al. (1995a, b) for relatively large aerosol particles, or by Douglas and French (1990, 1992) and Smith and Shaffer (2000) for ions. These techniques are all based on the finite inertia of the particles, as revealed by the early theoretical work of Robinson (1956; see also Fernandez de la Mora, 1996). Because the inertia of very small particles at relatively large or near atmospheric pressures is very small, none of these schemes has succeeded so far at achieving the desired concentration of ions at atmospheric pressure. The focusing element claimed in the Douglass-French patent is "a first rod sot" and is required to be in a "first vacuum chamber". The alternative funnel system of Smith and Shaffer (2000) is claimed in their patent to function up to 1 Bar (0.99 atmospheres). However, the many embodiments of their invention tried to date with mass spectrometric advantage, have always relied on focusing elements operating at pressures substantially below one atmosphere. In all known focusing devices used to date in which substantial concentration has been achieved for mass spectrometry applications, the gas sample is initially passed from its source (often at atmospheric pressure) into a region of reduced pressure. On the other hand, the notable sensitivity advantages yielded by the concentration schemes currently practiced at reduced pressure could be much enhanced if the sample gas were also enriched substantially at its initial source pressure (often atmospheric). The present invention teaches how to achieve this desired concentration at relatively high pressure, including atmospheric and super-atmospheric conditions. This advantage is evident from the fact that the maximum sensitivity achievable by an instrument sampling a fixed flow rate of gas is proportional to this flow rate times the sample concentration. If this concentration is increased by a certain factor F prior to the inlet to the instrument, the instrument's sensitivity can be increased by a factor as high as F. The present invention teaches also how to greatly increase the charging probability of neutral species in a gas, by performing the charging inside a charged particle concentrator. The charging probability is increased not only by obtaining unusually high concentrations of charging species and maintaining them over large volumes, but possibly also by concentrating the ionized vapors in the same charging device.

The two types of concentration devices known currently are either aerodynamic or electrodynamic. The theory for the first kind is relatively well known, and the obstacles to achieve aerodynamic focusing of small particles at atmospheric pressure are difficult to overcome due to basic fluid dynamic reasons. The improvement to be introduced by this invention is therefore directed mainly to electrodynamic focusing devices, and can therefore be effective only for charged particles. Our approach will be to first analyze the ion guide system most often used, a linear multipole lens conceptually identical to those introduced by Douglas and French (1990, 1992) to achieve ion focusing at reduced pressures. These systems involve a relatively large number of free parameters (gas pressure; rod radius, length and other geometrical characteristics; frequency of alternation of the voltage (RF) and voltage; ion mass and electrical mobility, etc.), such that the search for conditions suitable for effective operation at elevated pressure has in the past been unsuccessful, in spite of considerable efforts invested in this effort. This has led to the widespread opinion that effective ion concentration at atmospheric conditions is impossible. The theory taught here, however, enables the efficient identification of optimal operating parameters, and shows what combination of characteristic dimensions and frequencies must be used for useful focusing under atmospheric pressure. The theory is taught for the case of quadrupole lenses, but it can be readily applied to other multipolar systems such as hexapoles, octupoles, etc. It can be similarly applied to other focusing geometries such as the funnels of Smith and Shaffer (2000). It is not restricted to the case of periodic (or quasi periodic) systems in time, but applies also (with suitable modifications) to periodic (or quasi periodic) systems in space, such as the aerodynamic lenses of Liu et al. (1995a, b), or their suitable electrostatic analogs. One should note that approximate theories describing the behavior of ions in multipole fields (or ion funnels) have been developed. These theories were originally conceived for ions moving in a vacuum, but they have been generalized to account for collisions with a background gas. One must however note that available so-called pseudo-potential theory holds only in the limit of large inertia, and does not apply at large pressure. The theory taught here is therefore new in the realm of electrostatic focusing, even though some elements of it have been previously published by Tolmachev et al. (1997, 2000, 2003)

Theoretical Background on of Inertial Focusing in Time Periodic Electric Fields

Consider the differential equation $$\frac{d^2x}{dt^2} + \frac{1}{\tau}\frac{dx}{dt} + aF(x)\cos(\Omega t) = 0, \tag{1}$$

where the first term is the particle acceleration in the x direction, the second term accounts for the drag exerted by the gas medium on the particle, and the third term is the negative of an external acceleration, taken to vary periodically in time with an angular frequency $\Omega$. The particle relaxation time $\tau$ is simply related to its electrical mobility and mass through Einstein's formula (16), while the linear relation between drag and speed implicit in equation (1) is generally suitable under high-pressure conditions. (1) is a one-dimensional form of Newton's vector equations, which is suitable for simple geometries such as linear multipole systems. Other geometries requiring a three-dimensional treatment are evidently conceivable, as are situations where the drag presents nonlinear effects and the second term of (1) needs to be generalized. Other more complex time dependent forces can evidently also be considered, including not only electrical, but also magnetic or fluid dynamic (associated to net motion of the background gas).

Introducing Eulerian coordinates x, y for the velocity field u (Fernandez de la Mora and Rosner, 1981), (1) may be written:

$$\partial u/\partial t + u\partial u/\partial x + u/\tau + aF(x)\cos(\Omega t) = 0 \tag{2}$$

This representation is eminently generalizable to the more complex three dimensional and nonlinear situations previously mentioned. We will consider first the limit of small inertial effects, when the nonlinear term u ∂u/∂x is relatively small and can be neglected to first approximation. We shall see that this approximation is particularly well justified under the conditions of high pressure of particular interest to this invention. The differential equation can then be integrated into the purely periodic solution $$u = \frac{-a\tau}{1+\Omega^2\tau^2}F(x)[\cos(\Omega t') + \Omega\tau\sin(\Omega t)]; \tag{3}$$

where a rapidly decaying term of the form $A(x)\,e^{-t/\tau}$ has not been included. The neglected term u∂u/∂x can now be evaluated to yield, $$u\partial u/\partial x = \frac{a^2\tau^2}{2(1+\Omega^2\tau^2)^2}FF_x[\cos(\Omega t) + \Omega\tau\sin(\Omega t)]^2;\ F_x = \frac{\partial F}{\partial x} \tag{4}$$

Net Drift.

If the correction (4) is now included in (2), it contributes two types of terms; some periodic with frequency 2Ω, another corresponding to the net drift velocity $u_o$:

$$u_o = \frac{-a^2\tau^3}{2(1+\Omega^2\tau^2)}FF_x \tag{5}$$

If one now averages the motion over one period, the harmonic contributions drop out, and the net motion is just that given in (5).

One can readily see that the three-dimensional generalization of (2) & (5) are:

$$\partial u/\partial t + u\cdot\nabla u + u/\tau + a\tilde{F}(r)\cos(\Omega t) = 0. \tag{2'}$$

$$u_o = \frac{-a^2\tau^3}{2(1+\Omega^2\tau^2)}F\cdot\nabla F. \tag{5'}$$

Making use of the fact that ∇×F=0, F·∇F=½∇(F·F), it follows that ions tend to focus at points where F·F is a minimum Limits of Validity of the Small Inertia Limit.

The validity of (5) is restricted by two types of considerations. First, the term u∂u/∂x treated as a perturbation must be small compared to those retained, hence, u∂u/∂x<<u/τ, or $$\tau\partial u/\partial x << 1. \tag{6}$$

This is equivalent to a conventional small Stokes number hypothesis (Fernández de la Mora and Rosner, 1981). Under atmospheric pressure conditions, even large ions have minute relaxation times τ of the order of $10^{-9}$ s, so that (6) would hold even at uncommonly large frequencies of 100 MH. In addition, the amplitude of the harmonic contributions in (3) averaged out in (4) must be sufficiently small to preclude ion loss on surrounding electrodes. If we introduce the Lagrangian coordinate y of a particle, its evolution in terms of the Eulerian coordinates x, t obeys:

$$dy/dt = \partial y/\partial t + u(x,t)\partial y/\partial x = u(x,t), \tag{7}$$

where u(x, t) is given by (3). Introducing the new dependent variable z defined in (8a), (7) becomes (8b)

$$z = y - x;\ \partial z/\partial t + u\partial z/\partial x = 0. \tag{8a, b}$$

The characteristic equations of this first order partial differential equation are separable:

$$z = \text{constant along}; \tag{9}$$

$$dt[\cos(\Omega t) + \Omega\tau\sin(\Omega t)] = \frac{-dx(1+\Omega^2\tau^2)}{a\tau F(x)}$$

The Case of a Quadrupole.

In the special case of an radio frequency (RF) quadrupole, aF(x) is defined in (10a), where the ion charge is e, m is its mass, V is the RF potential, 2R the distance between two opposite electrodes, and the angular frequency ω is defined approximately in (10b)

$$aF(x) = \omega^2 x;\ \omega^2 = 2\,eV/(mR^2). \tag{10a, b}$$

Then, the small Stokes number condition (6) becomes:

$$\frac{\omega^2\tau^2}{1+\Omega^2\tau^2} << 1. \tag{11}$$

(9) may also be integrated explicitly to yield $$\ln(y/x_o) = (\omega^2\tau/\Omega)\frac{\sin(\Omega t) + \Omega\tau\cos(\Omega t)}{1+\Omega^2\tau^2}, \tag{12}$$

where $x_o$ is a constant of the motion simply related to the initial value of y. Because the maximum value of the second right hand side factor in (12) is of order unity, $y/x_o$ is of the order of $\exp(\omega^2\tau/\Omega)$, and the group $\omega^2\tau/\Omega$ can at most take values of order one:

$$\Omega\tau > \omega^2\tau^2. \tag{13}$$

Typically then, ωτ must be small, while Ωτ can be large or small, but it cannot be smaller than the generally small number $\omega^2\tau^2$.

The time needed for focusing follows from the time-averaged equation for u:

$$dx/dt = -u_o, \tag{14}$$

which, in the case of a quadrupole, is linear in x, whereby x decays as $\exp(-t/t_o)$, with a characteristic time $$t_o = 2\tau(1+\Omega^2\tau^2)/(\omega\tau)^4 \tag{15}$$

Because ωτ needs to be small for these results to hold, it follows that this decay time or focusing time is considerably larger than τ. Very worth noting is the cubic dependence of $t_o$ on pressure through the term τ~1/p, which explains quantitatively the qualitatively well known difficulty of extending to high pressure the operating range of a quadrupole lens. Indeed, a quadrupole designed to work at the relatively high pressure (by current standards) of 7.6 Torr, would need at atmospheric pressure a time 1 million times larger to focus than under design conditions. Equally worth noting is that $t_o$ varies with the −4th power of ω, and hence varies as the $-4^{th}$ power of the lens dimension R and the second power of its voltage. Note in particular that the maximum voltage that can be used is considerably larger at atmospheric pressure than in the Torr range, and this compensates in part for the negative effect of increasing pressure. However, the principal means available to achieve moderate focusing times at high pressures is to use a quadrupole dimension R considerably smaller than in current practice. Fortunately, the fact that $t_o \sim R^{-4}$ enables effective focusing at manageable values of R of the order of 1 mm.

Typical Values

Einstein's equation may be written $$\tau = mZ/e, \tag{16}$$

while the electrical mobility of a sphere of diameter d is $$Z/e = 0.441(kT/\mu)^{1/2}/(pd^2), \tag{17}$$

where p is the background gas pressure, μ its molecular mass (28.8 amu for air) and kT its temperature in energy units. Taking a typical value for electrospray ions, m/c=1 kDalton, and favorable conditions of high RF voltage, V=3 kV, and small R (=1 mm), then $\omega = 2.4\ 10^7\ s^{-1}$ ($5.38\ 10^7\ s^{-1}$ when m/e=200 amu).

Using a material density of 1 g/cm$^3$ for the ions, p=1 atmosphere and a particle diameter of 5 nm (m=39.4 kDalton) we find $\tau = 3.3\ 10^{-9}$ s, hence $\omega\tau = 0.079$. For an ion of mass 200 amu and Z=2 cm$^2$/V/s, $\tau = 4.1\ 10^{-10}$. The small inertia condition (11) is therefore well met. The alternative condition (13) requires that $\Omega > 1.89\ 10^6$ 1/s (a frequency of 300 kHertz), which is generally exceeded in RF ion guides. On the other hand, due to the damping factor $(1+\Omega^2\tau^2)$ in the drift speed (3), it is preferable to keep $\Omega\tau < 1$, hence $\Omega < 3\ 10^8\ s^{-1}$ (frequency below 48 MHz), which is also generally satisfied in RF ion guides. According to (15), the corresponding time required for focusing is $t_o = 1.7\ 10^{-4}$ s at an RF frequency of 2 MHz. This is reasonably fast, and would only require a quadrupole length of some 20 cm to increase the ion concentration by a factor of 1000, even if the gas was moving at the speed of sound for room temperature air (340 m/s). An axial length of 6 mm would suffice for a gas jet moving at 10 m/s. A concentration factor of 1000 would imply that the inlet stream-tube of about 2 mm (R=1 mm) would shrink by a factor of $1000^{1/2}$ into a diameter of 63 μm, considerably smaller than the typical pinhole diameter of 250 μm of a mass spectrometer with an atmospheric pressure source. One could hence use a larger R value to fit ideally with the inlet orifice, but we will not pursue this optimal matching until we take Brownian diffusion and space charge considerations into account. We can nonetheless conclude that a small quadrupole running under atmospheric pressure can achieve a large concentrating effect. It would have the extra advantages over low pressure quadruples of being fragmentation-free, readily integrated to an electrospray source, small, compatible with low voltage operation, and having a wider mass range where focusing is effective. A key practical advantage of the type of atmospheric pressure ion focusing just discussed is that a given ion current could be passed through a considerably smaller pinhole inlet to a mass spectrometer. Furthermore, since the ions would be confined to the axis of the gas jet ingested, radial expansion of the gas into the vacuum would lead to a much reduced widening of the ion beam, so that a second stage of low pressure ion guide might not be needed, and, if present, it would pass a larger fraction of the ions into the high vacuum region of the MS.

Other Factors Affecting the Width of the Ion Beam

The main widening mechanisms available are Brownian motion and space charge. Brownian motion Let r denote the radial variable in a linear RF quadrupole, which could be either x or y. Under conditions of equilibrium the beam would expand radially as a result of diffusion, but would be confined by the net convective speed $u_o$ towards the axis given in (5), The ion number density n (1/cm$^3$) would then be governed by:

$$-D\partial n/\partial r + nu_o = 0, \tag{18}$$

where the diffusion coefficient D is given by Einstein's formula as D=kTτ/m. Its solution is $$n = n_o \exp(-r^2/\Delta^2);\ \Delta^2 = \frac{-4kT(1+\Omega^2\tau^2)}{m\omega^4\tau^2}. \tag{19}$$

Under the conditions of the quadrupole and the ions just described, the beam width Δ is of only 4 μm, much smaller than the typical MS inlet hole radius of 125 μm.

Space Charge

The limit just described holds in the absence of space charge. The question now is what current levels can be passed without substantial increase of ion beam cross section.

We consider the asymptote where the beam is already focused and does not evolve further in the axial direction. Then Poisson's equation is one-dimensional:

$$\frac{1}{r}\frac{d\,rE}{dr} = \frac{ne}{\varepsilon_o} \tag{20}$$

while the mass conservation equation for the number density n of ions is $$-D\frac{dn}{dr} + n(ZE - \alpha r) = 0 \tag{21}$$

where αr is the drift velocity of the ions in the quadrupole, given by (5) and (10) as:

$$\alpha = \frac{\omega^4\tau^3}{2(1+\Omega^2\tau^2)}. \tag{22}$$

Eliminating n in terms of E in (20) and substituting it into (21) yields a second order differential equation for the field E. It can be cast into the simpler form (25) by introducing the variables:

$$q = \frac{ZEr}{2D};\ y = \frac{\alpha r^2}{2D} \tag{23, 24}$$

$$\frac{d^2q}{dy^2} = \frac{dq}{dy}\left(\frac{q}{y} - 1\right) \tag{25}$$

The symmetry condition at the axis requires that E vanishes linearly with r, whereby q is linear with y:

$$q \to a_1 y \text{ as } y \to 0. \tag{26}$$

This provides initial values at the axis r=0 for q=0 and $dq/dy = a_1$, so that numerical solutions can be obtained in terms of the single parameter $a_1$. One can also provide a Taylor expansion solution at small y:

$$q = a_1 y + a_2 y^2 + \ldots + a_n y^n + \ldots \tag{27}$$

Substituting (26) into (25) and canceling terms of successive order in y we find:

$$a_2 = a_1(a_1 - 1)/2$$

$$6a_3 = 3a_1a_2 - 2a_2$$

$$12a_4 = a_1a_3 = 2a_2^2 + 3a_3(a_1 - 1)$$

$$\text{etc.} \tag{28}$$

The structure of the solution is as follows. The line $q=y$ ($a_1=1$) is a singular exact solution, which separates trajectories curved upward ($a_2>0$) from others curving downwards and evolving towards a horizontal line $q=q_o$ (also an exact solution to (25), though not satisfying (26)). The expected behavior is a number density n confined to a region near the axis, and decaying rapidly to zero beyond a certain radius. In the outer region where n=0, E decays as 1/r, and q tends to a constant. One can easily see that such constant asymptotes are attractors to the solution at increasing y. Indeed, $q/y<<1$ in the vicinity of this asymptote, whereby (25) becomes linear with solutions $q=A+B\,e^{-y}$, decaying rapidly to a constant. In contrast, upward curving solutions with $a_1>1$ eventually exhibit the opposite behavior with vertical asymptotes.

The structure of the physically meaningful solutions ($a<1$) computed numerically is shown in FIG. 1, where the horizontal and vertical variables are proportional to r and n, respectively One sees that at small initial values of $a=(dq/dy)_{y=0}$, the height increases with a, but the width changes little remaining close to the diffusion limit. At increasing $(dq/dy)_{y=0}$, both the height and the width increase monotonically. Finally, as a approaches unity, the ion density takes an almost constant value while the width keeps increasing indefinitely. This asymptote corresponds to the limit of the maximum charge density or "space charge limit" that can be attained in the quadrupole:

$$en_{max}=2\in_o\alpha/Z \tag{29}$$

Assuming that this space charge limit has been attained and that the beam is wide enough for the ions to fill all the gas streamlines sucked by the inlet orifice, the ion current ingested is equal to the inlet flow rate Q times $en_{max}$. For a typical value of Q=0.5 lit/min, the maximum ingested current we obtain for the same values used in the previous example is of 2.75 nA. This current is larger than can be ingested under most conditions, typical of atmospheric pressure ionization mass spectrometers (API-MS) systems, with the exception of so-called nanospray. In this later case the initial electrospray drops are so small that there is ample time for drop evaporation and ion formation even when the electrospraying tip is within an orifice radius of the sampling orifice, and the whole spray (several tens to one hundred nA) may be sampled into the vacuum. For most other situations of practical interest in electrospray mass spectrometry (ES-MS) the proposed atmospheric pressure lens would lead to considerable increases in sensitivity.

Species Stratification Under Space Charge Saturation

Tolmachev and colleagues (2000, 2003) have investigated space charge effects in ion guides and shown that there may be radial stratification of various ion types. A similar effect can be seen in our space charge model. Imagine there is a dominant ion (say from the ES buffer), and let's denote its properties $\alpha$ and Z with the subscript b (for buffer). Then, $E=r\alpha_b/Z_b$. Let us suppose there is a trace quantity of another ion with different properties $\alpha_i$, $Z_i$. Its radial velocity $v_i=Z_iE-\alpha_i r=rZ_i(\alpha_b/Z_b-\alpha_i/Z_i)$ can only be negative (movement towards the axis, hence concentration) provided that $$\alpha_i/Z_i>\alpha_b/Z_b \tag{30}$$

Hence, the ions with the largest $\alpha/Z$ will occupy the regions closest to the axis. In the polarization limit governing the mobility of small ions (McDaniels and Mason, 1973), this corresponds to the heaviest ions. Interestingly, Tolmachev et al. (2000) come to the opposite conclusion, perhaps because they consider the limit of small or intermediate pressures. In the different application of electrospray sources, the lighter ions rejected to the periphery are the buffer ions used to impart electrical conductivity to the liquid solution and hence provide a good electrospray. The heavier ions concentrating near the axis are therefore the most analytically relevant ions. In the different application of electrospray charging of neutral vapors, the use of a quadrupole to concentrate the electrospray drops (or ions) has two advantages. First, it concentrates the charging species (ions or drops) into the axis region at concentrations substantially larger than they would have in the absence of a quadrupole. This evidently enhances the charging efficiency of neutrals in the ambient going near the axis. Second, once charged, these ionized vapors are not displaced to the periphery by the dominant charge, but are instead conveniently kept near the axis, ready to be preferentially sample into the MS. In the case where drops rather than ions are the charging species, the situation may perhaps be the opposite initially, with the drops occupying the vicinity of the axis. But once drop evaporation is complete, provided there are no nonvolatile salt-forming species in the spray, the analytically interesting heavy ions occupy their place near the axis.

In conclusion, the use of RF fields created by arrangements of conductors with characteristic diameters and inter-electrode distances of the order of one millimeter is able to produce inertial effects sufficiently large to concentrate considerably ions and small particles at pressures as high as 1 atmosphere, prior to their introduction into an analytical instrument such as a mass spectrometer.

Axial Movement of the Ions

In the case of a relatively long quadrupole, an axial field is necessary to move the ions towards the MS inlet. This axial field does not exist naturally because the rods are at a fixed mean voltage all along their axis. Axial fields have nonetheless been implemented earlier by Sciex patents, relying on slightly conical rods (or a conical arrangement of the axes of cylindrical rods). Also by Brucker patents relying on the creation of an axial field outside the quadrupole rods, and through its finite radial penetration into the quadrupole axis (Franzen and Brekenfeld 2004). These ideas, however, are intended for low-pressure applications, where small axial fields suffice to compensate for a very small drag. Hence, their utility is uncertain under atmospheric pressure, where the drag acting on the ions is very high. The present invention will therefore rely not only on these previously taught schemes of axial propulsion, but also on a simpler convective scheme.

Axial Fluid Motion

The approach relies simply on a net axial flow of gas. A conventional multipole lens system has openings between the various rods on its sides, so any initial flow speed implemented at its entry would decay towards the exit region. This problem may be alleviated by closing the quadrupole on its four side openings (or the hexapole on its six lateral openings, etc.), for instance, by inserting a dielectric material in the lateral open space between the various rods. The presence of a dielectric material with dielectric constant $\in$ larger than 1 evidently modifies the electric fields inside the RF lens, but when the closure is implemented outside rather than inside the point where the various rods are closest to each other, such effects are relatively minor and do not alter in any significant way the general considerations made here. The advantage of this laterally closed quadrupole is evidently that an axial pressure gradient can be imposed leading to a controllable axial velocity.

We have indicated that this invention is not limited to multipole geometries, but includes also the ion guide types of U.S. Pat. No. 6,107,628 by Smith and Shaffer. These authors refer to their ion guides as ion funnels, because their shape has always been converging from a wide entry section to a narrow exit region. For our present purposes, these ion guides have the advantage of being closed laterally, as they are formed by approximately spatially periodic arrangements of conductors and insulating plates perforated so as to create an internal opening. This spatially periodic system of lenses leads to electrodynamic focusing in a manner similar to that of the aerodynamic focusing of Liu et al. (1995). Ion funnels have been constructed by the time consuming process of laying conducting and insulating plates one above the other, with their perforations of diminishing area executed prior to this assembly. The precision of this manual technique does not lend itself easily for our purpose of producing lenses with small characteristic cross section, suitable for high pressure operation. However, if the unperforated conducting and insulating plates and conductors are secured together, this assembly can then be perforated at once with a cylindrical drill of small dimensions, or with other conventional schemes used to perforate bulk material with cylindrical shapes, or other desired shapes, including tapered geometries.

SUMMARY OF THE INVENTION

This invention uses ion guides at unconventionally high pressures and unconventionally small dimensions to concentrate ions and other charged particles near the ion guide axis. This concentrating effect is exploited in various applications, including increasing the sensitivity of other analytical instruments, and increasing vapor charging efficiencies. Besides the small dimensions enabling effective concentration at near atmospheric pressures, the invention differs from prior art to concentrate ions in the absence of a high pressure ratio between the ion guide region and a preceding chamber through which ion carrying gases are conventionally introduced, The gas movement through the ion guide can therefore be relatively slow, and can even proceed in the direction normal to that of the movement of the ions.

DETAILED DESCRIPTION OF THE INVENTION

Figure 1:
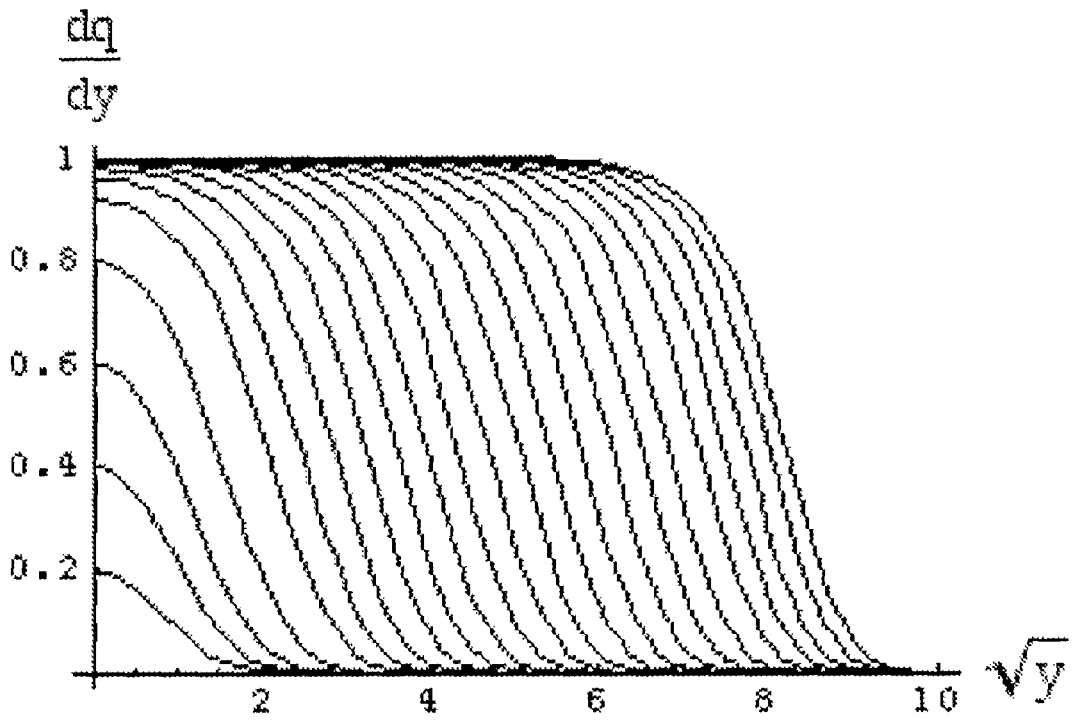
FIG. 1 shows the ratio of the ion density in units of its maximum possible value as a function of the dimensionless radial position within a quadrupole lens at various levels of filling of the traps.
Figure 2:
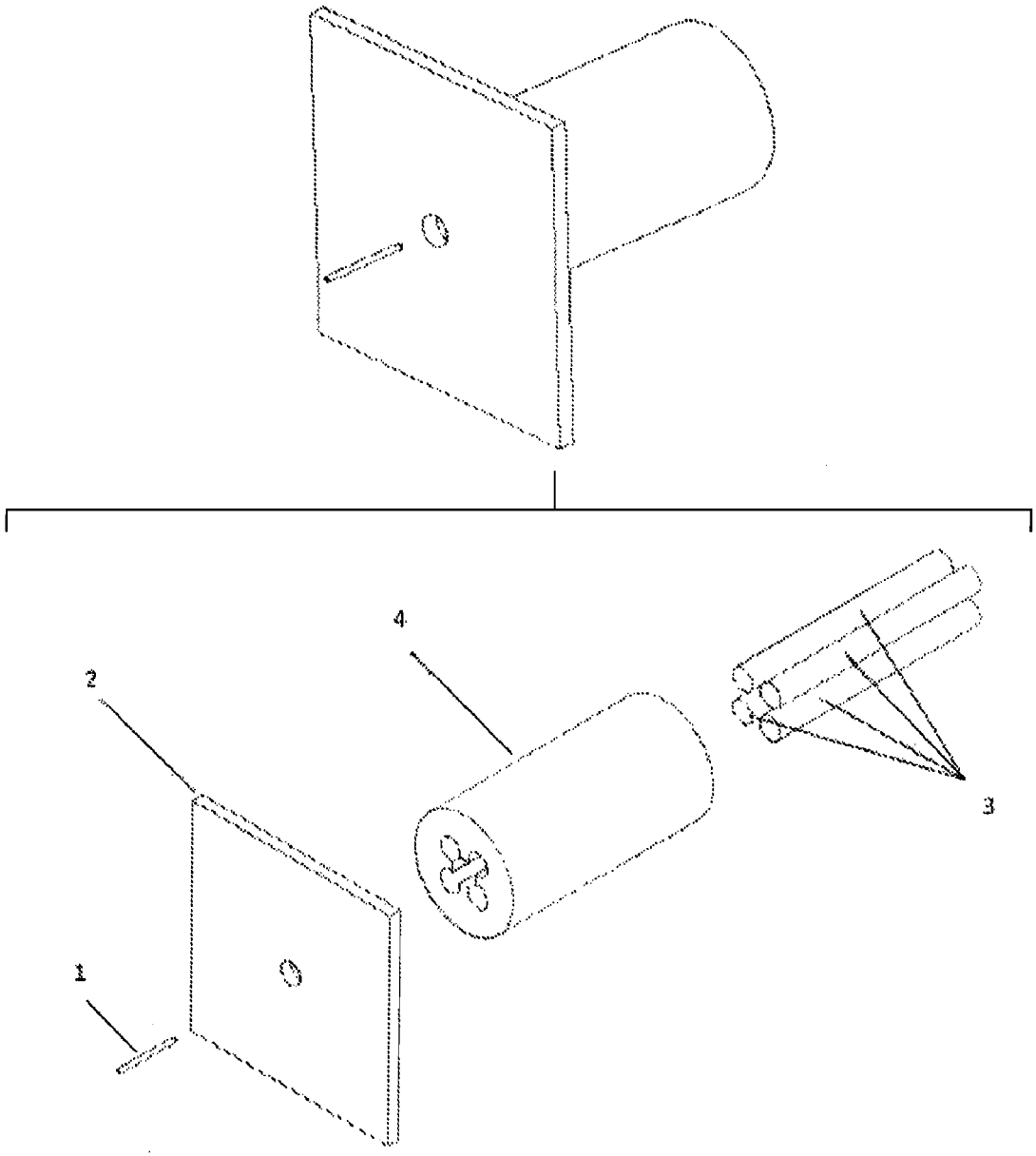
FIG. 2 is a schematic of a device for concentrating ions form an electrospray ion source based on a quadrupole lens type ion guide.

A preferred embodiment of this invention is shown in FIG. 2. It consists of an electrospray needle (1) facing an electrode (2) with an opening of about 1 mm in radius, not necessarily exactly coaxial with the emitting tip. Shortly after said orifice, and coaxial with it, is a linear multipole lens (3) run in the RF only mode. This RF lens is similar to that described in the work of Douglas and French, but the gas inside it is maintained here at a pressure comparable to that prevailing in the ion source, while the rod diameter and the opening between rods are much smaller here, of the order of 1 mm. In one embodiment of the invention, the electrospray source is fully enclosed in a chamber maintained at a pressure that may be smaller than that of the surrounding medium. Similarly, the RF lens may be closed on its exit region. It is closed on its sides by filling the gap between poles with an insulator (4), so that the pressure in the region inside the poles may be maintained below its entry value. Drying gas in the ambient region between the interior of the ES chamber and the interior of the RF lens may therefore enter into the electrospraying region through the orifice, in order to assist drop evaporation. This dry gas can similarly enter inside the RF lens, and move through it to facilitate the axial movement of the ions towards the exit of the lens. The electrospraying needle (1) may in this case be at a voltage a few kV above (or below for negative sprays) the perforated plate (2), which is in turn kept at a voltage higher than the reference voltage in the RF rods (generally ground). In an alternative embodiment, the electrospray is directed into the entrance of the multipole lens, without an intermediate perforated plate, and with the spray not necessarily coaxial with the lens. Dry gas may be blown (or sucked) at a relatively large speed into the entrance of the multipole lens, coaxially with it, in such a fashion that it entrains into the lens some of the ions and charged drops formed by the electrospray. In a third configuration the electrospray needle is approximately coaxial with the multipole lens and its spraying tip is very near the entrance to the lens, or even inside it, so that the full spray or a fair fraction of it is initially injected into the RF lens. In a fourth configuration the electrospray is produced in a closed chamber, and driven by a gas flow through a tube or a short nozzle, forming a jet that is directed into the entrance region of the RF lens. The transfer tube may be heated to help desolvation. A pre-filtering system such as a differential mobility analyzer (or another device separating ions according to their different motion in either electric fields or in combined electric and flow fields) may even be installed between the entrance and the exit of this tube. In either of these four configurations or in other related ones, some of the drops and ions formed are confined by the focusing effect near the multipole axis, even in situations where a drying gas is flowing with a contrary radial component. These ions are simultaneously moving axially along the lens, towards its opposite end, on whose vicinity the sampling orifice leading to a mass spectrometer or another analyzer is located. This axial movement of ions is propelled by a combination of the space charge field, the repulsive field from the electrospray needle, the gas suction from the inlet orifice leading to the MS, the axial speed induced on the gas by various additional means, or an external axial field created by a suitably arrangement of the electrodes or rods in the RF lens, or other external electrodes. As a result, the region in the vicinity of the sampling orifice leading to the MS is bathed by ions at a concentration considerably larger than that achievable in the absence of the RF lens. Furthermore, the confinement effect enables keeping the ions and charged drops axially confined for an unusually large time (or axial distance), allowing efficient desolvation and further production of ions.

Figure 3:
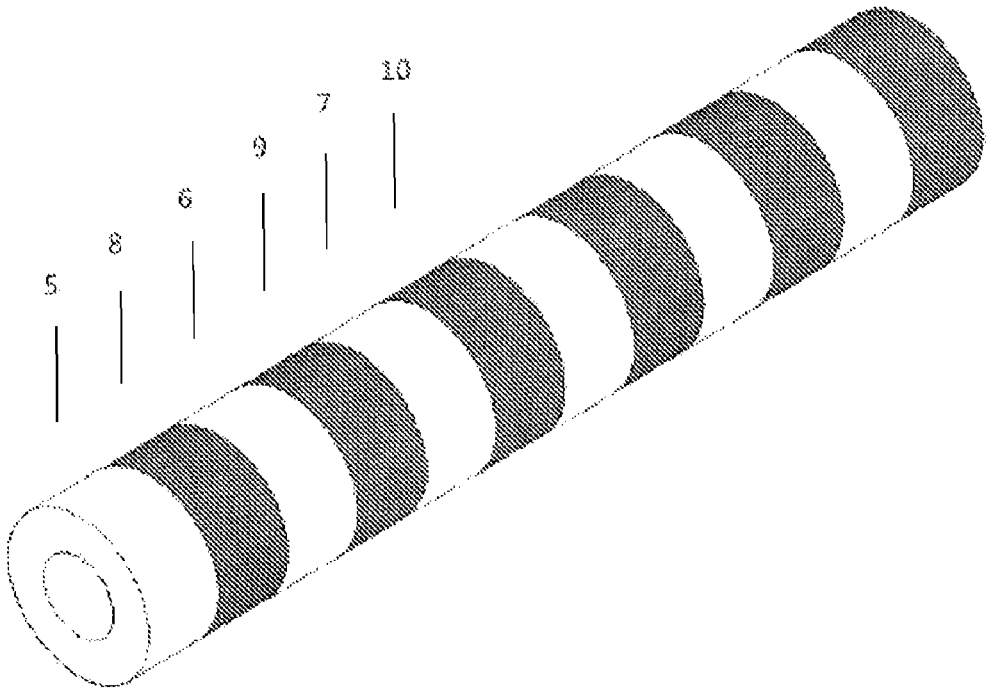
FIG. 3 is a schematic of an ion guide based on pairs of conducting and insulating plates.
Figure 4:
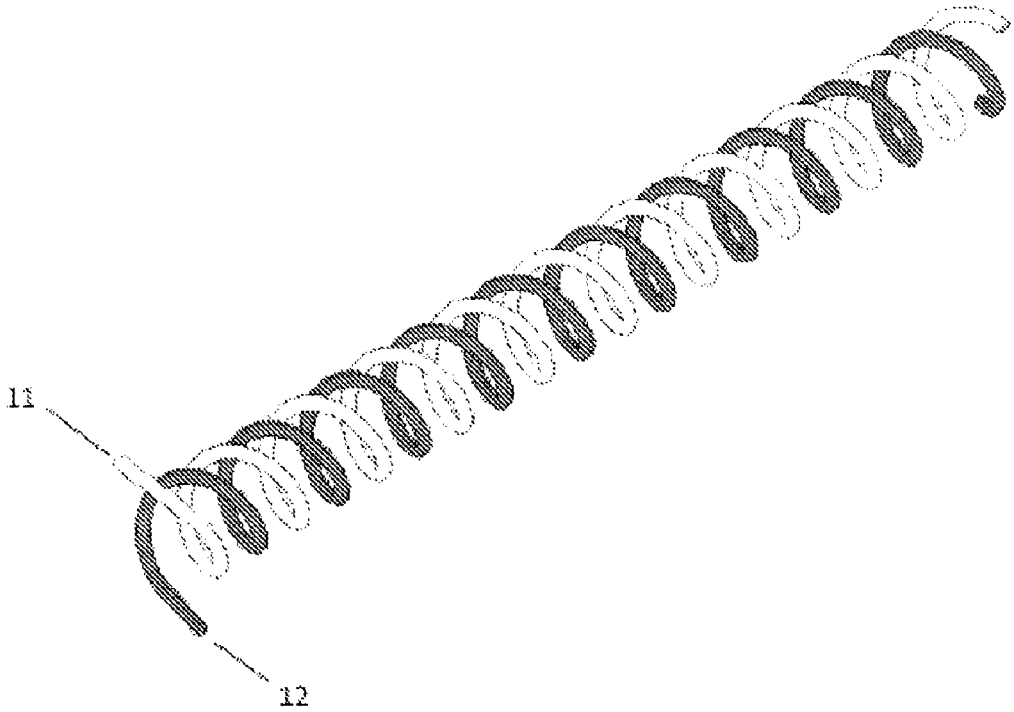
FIG. 4 is a schematic of an ion guide based on two or more coiled wires.

In a second embodiment of the invention (FIG. 3), the laterally closed multipole lens is substituted by a laterally closed periodic arrangement of insulating (5, 6, 7, etc.) and conducting (8, 9, 10, etc.) plates similar in structure to ion funnels. In this case the internal opening of the lens system is cylindrical, with a diameter typically smaller than 3 mm. The successive metallic plates are separated from each other by distances varying from less than one mm up to several mm and are charged to time varying voltages of equal or similar magnitude and waveform, but different phases. Typically the phase difference may be 180 degrees, but 120 degrees or other values may also be used, and have in fact been used in the past in related designs (Hutchins et al. 1991). In the common case relying a phase difference of 180 degrees, plates 5, 6 and 7 would be charged to periodically varying voltages V, −V, and V, respectively. The system just described based on U.S. Pat. No. 6,107,628 has one more advantage over multipole systems. In addition to the fact that it is naturally closed on the sides, it is now easier to impose axial electric fields by superposing to the RF potential an axial progression of a DC potential. This feature has been amply exploited in the past in low pressure designs. For our intended high pressure use, it offers the additional possibility of permitting the use of counterflow gas through the lens, going in a direction opposite to that of the ions. A third embodiment of the invention (FIG. 4) is suggested by the work of Hutchins et al. (1991), where the series of perforated plates in the second embodiment is substituted by two or more coiled wires (11, 12) charged at different phases. Each of the wires is displaced by a fixed distance along the axis of the coil from the preceding and subsequent wire. Therefore, in the vicinity of each point along the wires, the field is similar to that in the lenses of U.S. Pat. No. 6,107,628, consisting of a spatially modulated field along the length. This local similarity of fields is greater when there are only two coiled wires charged at voltages 180 degrees apart from each other. In the coiled design of Hutchins et al. (1991) there is an additional effect associated not only with the rotation of the field during each period, but also to its axial advance. The electric field waves in the coiled design therefore are not strictly standing waves, but can be viewed as rotating and axially propagating (helicoidal) waves. In this sense, they should be expected to aid in the axial movement of the ions, in crude analogy to the traveling wave system used commercially by Waters in the Synapt mass spectrometer. This traveling wave feature is of some practical interest in the Hutchins lenses, which cannot implement axial fields as effectively as the Smith design. The main effect of the RF field is nonetheless similar in the Hutchins and the Smith designs, consisting primarily of a net repulsive force pushing the ions away from the walls, towards the axis of the lens system. The axial progression of the wave during one period becomes more evident as the phase difference between neighboring coils decreases below 180 degrees. The Hutchins design in fact used three coils with 120 degrees of phase difference. The Hutchins coils were also of decreasing cross section, similarly to the Smith funnels. FIGS. 2, 3 and 4 show embodiments of our own lenses with an axially uniform cross section, although our invention includes also tapered designs. FIG. 4 is drawn for simplicity for two coils and a phase difference of 180 degrees, but other alternatives with three or more coils per axial period are also included in the invention. Also, for simplicity, FIG. 4 does not show the walls required to close the lens system laterally, forcing axial progression of the ions carried by the fluid. In one embodiment of the invention using the coiled wires, this lateral enclosure is cylindrical and contains coiled grooves meant to lodge the outer region of the wires and fix precisely their pitch. Another embodiment of the invention is meant to ionize vapors with efficiencies higher than conventionally achievable with an unipolar source of ions or charged drops, such as an electrospray source or a corona discharge. In this system, a gas containing the vapors one wishes to ionize bathes the interior of the RF lens. The entrance region to the lens is exposed to a source of charging ions, such as an electrospray source or an electrical discharge, so that these charging ions enter into the RF lens, and fill it at high volumetric charge densities and over very wide axial lengths, both much larger than normally permitted by space charge fields. The vapor is then exposed to an unconventionally large density of charging ions or drops over an unconventionally long time, and is furthermore focused into the axial region of the quadrupole. Hence, an unusually large fraction of the neutral vapor species present in the ambient may be charged and sampled at the exit of the RF lens into an analytical instrument such as a mass spectrometer or a differential mobility analyzer. Any of the three lens systems discussed previously for ion focusing purposes, and their many variants, could similarly be used for this vapor charging application.

Variants of these devices using ion sources other than electrospray, or analyzers other than mass spectrometers, or RF lens systems other than linear multipoles, funnels or helical wires are also included in this invention.

Relation to Prior Ion Guiding Systems

All previous art for ion (rather than microscopic particle) focusing has involved a focusing stage at pressures considerably lower than atmospheric. Although the proposed arrangement of lenses is similar for atmospheric and for reduced pressure operation, there is, however, a crucial difference not only in the state of the background gas, but also in the manner in which the ions to be concentrated are introduced into the focusing region. In traditional low-pressure ion guide systems, the ions are generally conveyed to the focusing region by a highly supersonic jet of gas. This is not the case in the present invention. In one possible embodiment, the gas could actually flow in the direction contrary to that used in traditional RF lenses, and the ions would be conveyed by the electric field without assistance of the flow field. In an alternative embodiment discussed, a flow of gas aids the electric field in transporting the ions into the focusing region, but the background gas is moderately supersonic, transonic or even low subsonic rather than having conventional highly supersonic speeds.

These considerations are not intended to imply that the present invention includes only subsonic gas flows. One can in fact consider situations where some of the embodiments discussed would involve speeds larger than the speed of sound, where the ratio of pressures would be moderate. In contrast, prior art has used pressure ratios typically between 760 and 0.1 torr, and in all cases larger than 760/20 torr. The current invention therefore encompasses situations where the ratio of pressures between the ion source and the focusing region does not exceed 20.

The invention claimed is:

1. A method to concentrate ions contained within a gas prior to the analysis of said ions in a mass spectrometer or another analytical instrument, including the following steps:

a) providing a first region where the gas containing the ions is maintained at an initial pressure $P_1$, b) providing an ion guide separated from said first region by at least one electrode, said electrode having an opening communicating an entry region in said ion guide with said first region, said ion guide having also an exit region evacuated through an outlet, said opening and said outlet being configured such that said ions pass from said first region into said ion guide through said opening with a background pressure $P_2$ being defined in said entry region, with the resulting pressure ratio of $P_1/P_2<20$, c) providing axial transmission means to cause said ions to move axially through said ion guide from said entry region towards said exit region, wherein, said ion guide incorporates two or more electrodes powered by two or more alternating high voltages, so as to confine said ions within a limited region of said ion guide.

2. A method according to claim 1 wherein said ion guide is closed laterally, such that said gas cannot escape substantially through the sides of said ion guide, and said axial transmission means is provided by axial movement of said gas driven by a pressure difference across the length of said laterally closed ion guide.

3. A method according to claim 1 wherein said two or more electrodes are either of a multipole type, or a helicoidal wire type.

4. A method according to claim 1 wherein said two or more electrodes include a coaxial series of sequentially arranged electrodes and insulators, and said axial transmission means include a net electric field established along the axis of said ion guide.

5. A method according to claim 1 wherein said two or more electrodes are of a helicoidal wire type, and said axial transmission means rely in part on the forward propagation component of the electric wave generated by said helicoidal wires.

6. A method according to claim 1, wherein a counterflow gas is provided which moves axially in the direction opposite to the direction of axial movement of said ions.

7. A method according to claim 1 wherein said ions are produced by an electrospray source and transported into said ion guide by a suitable ion transfer system.

8. A method according to claim 1 wherein said ions go first through a stage of separation based on their electrical mobility, before being concentrated within said ion guide.

9. A method according to claim 1 wherein said two or more electrodes include a coaxial series of sequentially arranged electrodes and insulators.

10. A method to charge vapor species contained in a gas with improved charging probability, including the following steps:

a) sampling said gas containing said vapors into an ion guide, b) introducing relatively high concentrations of charging ions or drops from an ionization region into said ion guide, such that charge may be transferred within said ion guide from said ions or drops into said vapors, turning them into ionized vapors, c) providing electrodes charged to steady and time dependent electric fields within said ion guide so as to moderate the natural tendency of said charging ions or drops to disperse by space charge repulsion and thereby increase the efficiency with which said vapors are ionized, d) where, with said gas being at a pressure of generally 760 torr upon being sampled, said gas is at a pressure larger than 38 torr, upon entering said ion guide.

11. A method according to claim 10 wherein said electrodes are configured as in an ion guide.

12. An apparatus to concentrate ions contained within a gas prior to the analysis of said ions in a mass spectrometer or another analytical instrument, said apparatus comprising:

a first region for containing the gas at an initial pressure $P_1$, a second region having an entry region in communication with said first region through an inlet, said second region having an exit region evacuated through an outlet, an ion guide disposed in said second region, said ion guide incorporating two or more electrodes powered by two or more alternating high voltages, so as to confine ions within a limited region of gas passing through said ion guide, and axial transmission means to cause the gas to move through said ion guide from said entry region towards said exit region, wherein, said inlet being configured such that the gas passes from said first region into said ion guide through said inlet with a background pressure $P_2$ being defined in said entry region, with the resulting pressure ratio of $P_1/P_2<20$.

* * * * *